United States Patent [19]

French

[11] 4,029,360

[45] June 14, 1977

[54] METHOD OF RECOVERING OIL AND WATER FROM IN SITU OIL SHALE RETORT FLUE GAS

[75] Inventor: Gordon B. French, Rifle, Colo.

[73] Assignee: Occidental Oil Shale, Inc., Grand Junction, Colo.

[22] Filed: Apr. 2, 1976

[21] Appl. No.: 672,874

Related U.S. Application Data

[63] Continuation of Ser. No. 492,598, July 26, 1974, abandoned.

[52] U.S. Cl. ..... 299/2; 166/256; 166/265; 166/302; 55/80

[51] Int. Cl.[2] ..... E21C 41/10; E21B 43/00

[58] Field of Search ..... 299/2–5; 166/258, 262, 256, 302, 303, 257, 265, 266; 208/11; 48/DIG. 6; 55/80

[56] References Cited

UNITED STATES PATENTS

| | | | |
|---|---|---|---|
| 947,608 | 1/1910 | Betts | 48/DIG. 6 |
| 1,269,747 | 6/1918 | Rogers | 299/2 |
| 2,990,691 | 7/1961 | Glasgow | 55/80 UX |
| 3,001,776 | 9/1961 | Poolen | 299/2 |
| 3,454,958 | 7/1969 | Parker | 166/256 |
| 3,460,867 | 8/1969 | Cameron et al. | 299/18 X |

*Primary Examiner*—Ernest R. Purser
*Assistant Examiner*—William F. Pate, III
*Attorney, Agent, or Firm*—Christie, Parker & Hale

[57] ABSTRACT

A technique is described for reducing the content of oil and water in the flue gas recovered from the bottom of an underground in situ oil shale retort. In such a retort air is passed downwardly to sustain a combustion zone for retorting oil which is recovered at the bottom. Flue gas recovered from the bottom of the retort contains water vapor and oil and water aerosols. These are removed from the flue gas by passing it a substantial distance upwardly through cool overburden so that the flue gas is cooled below its dew point so that water condenses in the vertical conduit and aerosols are dropped out on the walls. The oil and water are recovered at the bottom of the conduit and stored in an underground sump.

5 Claims, 1 Drawing Figure

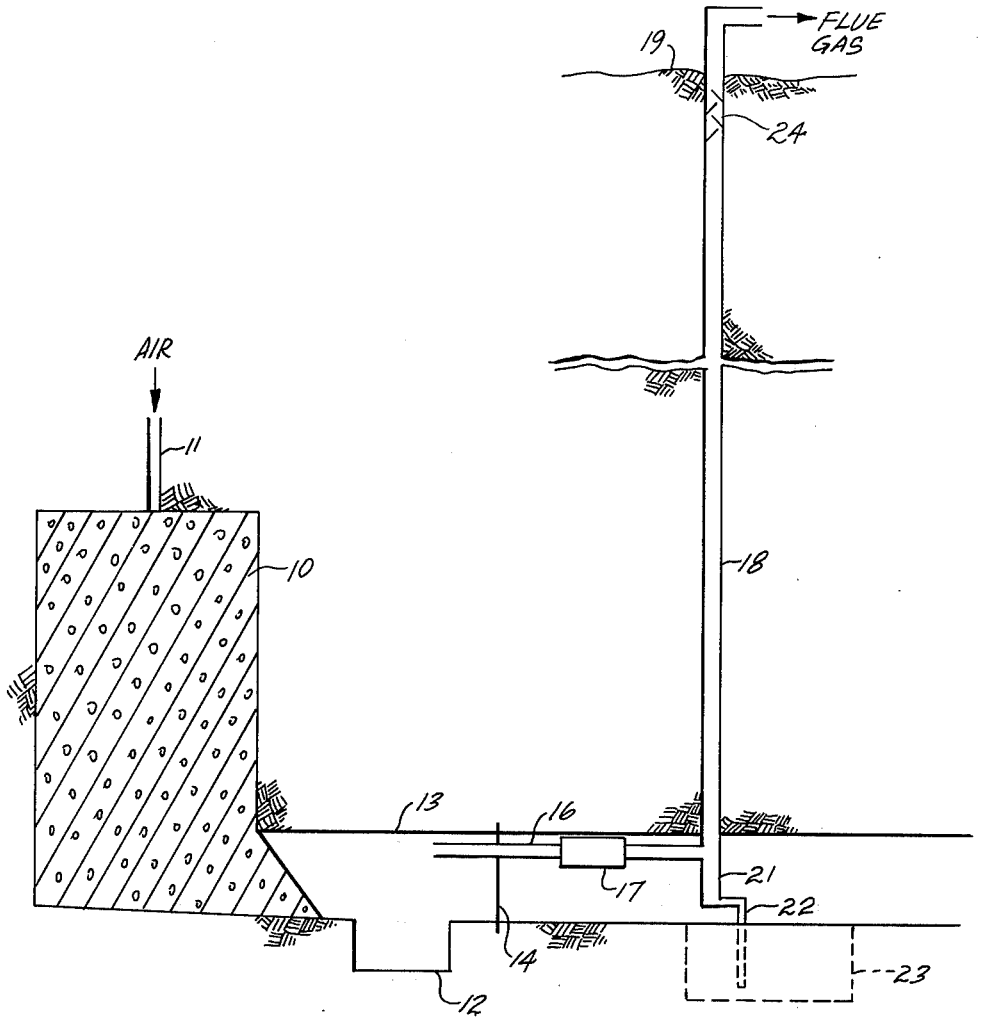
FLUE GAS
19
24
AIR
11
10
18
13
16
17
21
22
14
12
23

METHOD OF RECOVERING OIL AND WATER FROM IN SITU OIL SHALE RETORT FLUE GAS

This is a continuation of applicaton Ser. No. 492,598, filed July 26, 1974 now abandoned.

BACKGROUND

There are vast deposits of oil shale in the world containing massive reserves of oil that can supplement or replace petroleum supplies. The oil shale contains kerogen which is a solid carbonaceous material from which shale oil can be retorted. Shale oil is retorted by heating the oil shale to a sufficient temperature to decompose kerogen and produce a liquid product which drains from the rock. Small amounts of hydrocarbon gas are also produced. The spent shale after oil has been removed contains substantial amounts of residual carbon which can be burned to supply heat for retorting.

In a particularly desirable process for retorting oil shale a subterranean cavity or room is filled with an expanded mass of oil shale particles and retorting is conducted in situ. The expanded mass of particles and the underground retort are ordinarily formed explosively by any of a variety of known techniques. This retort is ordinarily filled to the top with a mass of oil shale particles known as a rubble pile. The top of this bed of oil shale particles is ignited and air is forced downwardly therethrough for combustion of carbonaceous material in the shale. Initially some of the shale oil may be burned but as retorting progresses much of the combustion is of residual carbon remaining in the spent shale. This reduces the oxygen content of the air and the resultant gas passing downwardly through the retort below the combustion zone is essentially inert. This inert gas transfers heat downwardly and results in retorting of the shale below the combustion zone without appreciable combustion of the resulting oil. The flue gas at the bottom of the retort is largely nitrogen, with carbon dioxide, carbon monoxide, water vapor, hydrogen, methane, and traces of other hydrocarbon gases. The flue gas has appreciable amounts of water and oil in the form of aerosol dispersions. It may also contain sulphur dioxide from the combustion processes.

Often it is desirable to recirculate a portion of the flue gas through the retort with the incoming air to enhance the heating value of the flue gas or to increase the yield of oil by burning combustible material in the flue gas in lieu of retorted shale oil. Cleaning of the flue gas prior to recirculation or venting to the atmosphere is desirable. Further, if the flue gas is employed in a gas turbine or the like to provide power it is desirable to preliminarily clean the flue gas prior to combustion to minimize turbine corrosion. There is also a substantial amount of water vapor in the flue gas and it is desirable to recover the water for various uses in the retorting process.

It is, therefore, desirable to have a technique for reducing the water content of the flue gas and minimizing the amount of entrained oil and water.

BRIEF SUMMARY OF THE INVENTION

There is, therefore, provided in practice of this invention according to a presently preferred embodiment a method for reducing water and oil content of oil shale retort flue gas by collecting the flue gas in a conduit at the bottom of the retort and passing it upwardly through an elongated conduit in heat transfer relation with relatively cool overburden a sufficient distance to lower the flue gas temperature to less than the dew point of the flue gas so that water is condensed in the conduit and oil and water aerosols are collected on the walls of the conduit. The oil and water flow to the bottom of the conduit and are recovered underground.

DRAWING

These and other features and advantages of the present invention will be appreciated as the same becomes better understood by reference to the following detailed description of a presently preferred embodiment when considered in connection with the accompanying drawing which illustrates semi-schematically an arrangement for retorting oil shale and reducing oil and water content of the resultant flue gas.

DESCRIPTION

The drawing is a semi-schematic vertical cross section drawn without regard to scale, since, in general, relative dimensions are not of significance in practice of this invention. As illustrated in this presently preferred embodiment there is an underground retort 10 in the form of a room in substantially undisturbed shale. The interior of the room is filled with a rubble pile of fragmented oil shale particles. This bed of oil shale particles and the room are created essentially simultaneously by means of explosives. Air is passed downwardly through a conduit 11 to enter the top of the retort 10. The air passes downwardly through the retort for supporting a combustion zone moving slowly downwarly through the bed of oil shale particles. The heat from combustion retorts the shale oil which flows from the bottom of the room into a sump 12 in a laterally extending tunnel 13. Oil and water are recovered from the sump 12.

The retort is sealed from the tunnel beyond the sump by a gas tight bulkhead 14 which is typically a steel plate cemented into the rock or a concrete barricade. A conduit 16 extends through the bulkhead for collecting flue gas adjacent the bottom of the retort. The conduit may end in the tunnel near the bulkhead or may be extended in the form of one or more perforated pipes into the lower portion of the bed of oil shale particles in the retort. The flue gas is preferably passed through a separator and/or Venturi scrubber 17 for removing substantial amounts of entrained oil and water.

The flue gas then passes to an elongated substantially vertical conduit 18 extending upwardly from the tunnel to the ground surface 19. At the ground surface the flue gas may pass to a vacuum pump, gas scrubbers, vents, recycle lines and the like which are not of concern in practice of this invention. The vertical conduit may typically extend 500 feet or more from the level of the tunnel 12 to the ground surface 19. Throughout this distance it is passing through relatively cool overburden that overlies the beds of shale to be retorted. Typically, for example, this is a relatively impervious marlstone and if desired the conduit can be simply a bore hole through the solid rock so long as means are provided for sealing the end portions to minimize leakage. Alternatively, the bore hole may be provided with a casing in the manner of oil wells so that the flue gas is actually flowing inside a pipe in the bore hole. In a typical embodiment an eight inch pipe may be passed through a 10¾ inch bore hole. Such an arrangement effectively eliminates any possibility of leakage of the flue gas but reduces the rate of heat flow from the flue gas into the rock formations. Even so, heat transfer is sufficient between the upwardly flowing flue gas and the relatively cooler overburden around the conduit 18 that the temperature of the flue gas is dropped well below its dew point.

This temperature reduction in the flue gas causes condensation of water on the walls of the conduit. In addition, the flue gas is in turbulent flow and aerosols are contacting the conduit walls. Appreciable quantities of oil and reusable water therefore collect on the inside walls of the conduit. These liquids flow downwardly in the conduit and eventually collect in a standpipe 21 at the bottom of the conduit. The standpipe is located below the collection conduit so that it is out of the gas flow path.

A pipe 22 from the bottom of the standpipe leads to an underground sump 23 (the sump is indicated in dotted lines in the drawing since it is preferably displaced laterally from the main tunnel 13 so as not to interfere with other operations). The oil and water coming out of the flue gas in the vertical conduit 18 are recovered from the underground sump. The lower end of the pipe 22 to the sump may be left open since the pressure in the conduit may be less than the ambient pressure in the tunnel and so long as liquid remains in the underground sump there is no leakage and liquids flow from the standpipe automatically. Alternatively, if a higher pressure is present in the conduit the lower end of the pipe may be left open under a sufficient head of liquid in the sump to prevent gas leakage. Alternatively, a float controlled valve may be provided in the recovery pipe.

In a typical oil shale retorting operation the vertically extending conduit 18 may be an 8 inch pipe as mentioned above. The gas flow velocity through the pipe may be in the order of six to ten thousand feet per minute. The total length of the conduit 18 is preferably in the range of about 500 to 1000 feet. If it is less than about 500 feet the volume of rock available for heat flow may be too low for needed heat dissipation.

Towards the end of the operation the temperature of the flue gas at the bottom of the retort during normal retorting operations is in the order of about 140° F. After passing through the elongated vertical conduit through the relatively cool overburden the temperature of the flue gas may be lowered to the order of about 60° to 70° F. This substantial cooling of the flue gas causes a large condensation of water on the walls of the conduit. Further, turbulent flow of gas through the conduit brings oil and water aerosols into contact with the walls where they are removed and run down the walls with the collected water. The oil is recovered as a saleable product and the water recovered from the underground sump is used in various retorting operations.

Since the flow rate of gas through the vertical conduit is moderately high, small droplets of oil or water may be entrained and carried upwardly. This effect can be minimized by providing demisters in the conduit so that droplets impinge and coalesce on surfaces from which they can drain to the walls of the conduit and eventually back to the sump at the bottom. Baffles may be introduced in the conduit to assure turbulent flow and direct flow such that the droplets are caused to impinge on the walls. Restrictions or other means may also be employed for modifying flow velocity in some regions of the conduit so that coalescence of the droplets and condensation of materials is enhanced. A broad variety of such measures for reducing the vapor and entrained aerosol content of the gas flowing in the conduit will be apparent to one skilled in the art. The baffles, demisters, etc., are preferably located near the top of the conduit as indicated schematically at 24 in the drawing so that gas cooling has occurred and any aerosol content of the gas is fully developed.

Although limited embodiments of technique for reducing aerosols and water content of flue gas from an underground oil shale retort have been described and illustrated herein, many modifications and variations will be apparent to one skilled in the art. Thus, for example, if the amount of heat that must be dissipated is largely due to a greater gas volume, parallel upwardly extending conduits through the overburden may be used to increase the area through which heat flows. Many other modifications and variations will be apparent to one skilled in the art and it is therefore to be understood that within the scope of the appended claims the invention may be practiced otherwise than as specifically described.

What is claimed is:

1. A method of reducing the water content of flue gas from an underground in situ oil shale retort in a subterranean formation containing oil shale comprising the steps of:

collecting flue gas from an underground in situ retort, said flue gas having water vaporized therein;

passing the flue gas through an elongated conduit extending through at least one subterranean rock formation in heat transfer relationship with at least one such rock formation for a sufficient distance to lower the flue gas temperature to a temperature of less than the dew point of the collected flue gas for condensing water from the flue gas, at least a portion of such a rock formation having a temperature at the conduit of less than the dew point of said flue gas; and recovering water condensed from the flue gas from the elongated conduit.

2. A method as defined in claim 1 wherein the flue gas is passed through at least about 500 feet of subterranean rock formation.

3. A method of reducing oil and water content of flue gas from an underground in situ oil shale retort in a subterranean formation containing oil shale comprising the steps of:

collecting flue gas from an underground in situ retort, said flue gas having water vaporized therein and oil and water droplets entrained therein;

passing the flue gas through an elongated conduit extending through at least one subterranean rock formation in heat transfer relation with at least one such rock formation at a rate sufficient for turbulent flow for contacting the walls of the elongated conduit with entrained oil and water droplets for collection thereof, for a sufficient distance to lower the flue gas temperature to a temperature of less than the dew point of the collected flue gas for condensing water from the flue gas; and recovering oil and water from the elongated conduit.

4. In an underground in situ oil shale retorting system having an underground retort in a subterranean formation containing oil shale comprising a room in said formation containing a bed of fragmented oil shale particles with a sufficient distributed void volume to permit gas flow therethrough, means for introducing air into the retort for supporting a combustion zone in the bed and moving said combustion zone therethrough for retorting oil shale and producing shale oil and flue gas having water vaporized therein, means for recovering shale oil from the retort, and means for collecting flue gas from the retort, the improvement comprising:

an elongated conduit extending through at least one subterranean rock formation in heat transfer relation with at least one such rock formation a sufficient distance to lower the temperature of flue gas passed therethrough to less than the dew point of the collected flue gas, at least a portion of such a rock formation having a temperature at the conduit of less than the dew point of the flue gas; and means in fluid communication with the conduit for recovering water condensed from said flue gas passed therethrough comprising:

standpipe means in fluid communication with the conduit and located out of the gas flow path for collecting water condensed in said conduit;

sump means for collecting oil and water; and means for conveying water from the standpipe means to the sump means.

5. In an underground in situ oil shale retorting system having an underground retort in a subterranean formation containing oil shale comprising a room in said formation containing a bed of fragmented oil shale particles with a sufficient distributed void volume to permit gas flow therethrough, means for introducing air into the retort for supporting a combustion zone in the bed and moving said combustion zone therethrough for retorting oil shale and producing shale oil and flue gas having water vaporized therein and having water and oil aerosols entrained therein, means for recovering shale oil from the retort, and means for collecting flue gas from the retort, the improvement comprising:

an elongated conduit extending through at least one subterranean rock formation in heat transfer relation with at least one such formation a sufficient distance to lower the temperature of flue gas passed therethrough to less than the dew point of the collected flue gas for condensing water from the flue gas, at least a portion of such a rock formation having a temperature at the conduit of less than the dew point of the flue gas; and means in the conduit for removing liquid droplets from the flue gas passed therethrough; and means in fluid communication with the conduit for recovering oil and water.

* * * * *